US007538640B2

(12) United States Patent
Tsuji et al.

(10) Patent No.: US 7,538,640 B2
(45) Date of Patent: May 26, 2009

(54) WAVEGUIDE AND ATTENUATION POLE WAVEGUIDE BANDPASS FILTER

(75) Inventors: Mikio Tsuji, Kyotanabe (JP); Hiroyuki Deguchi, Kyotanabe (JP); Masataka Ohira, Kyotanabe (JP)

(73) Assignee: The Doshisha, Kyoto (JP)

( * ) Notice: Subject to any disclaimer, the term of this patent is extended or adjusted under 35 U.S.C. 154(b) by 67 days.

(21) Appl. No.: 11/665,337

(22) PCT Filed: Dec. 26, 2005

(86) PCT No.: PCT/JP2005/023729

§ 371 (c)(1),
(2), (4) Date: Apr. 13, 2007

(87) PCT Pub. No.: WO2006/092901

PCT Pub. Date: Sep. 8, 2006

(65) Prior Publication Data

US 2008/0197944 A1 Aug. 21, 2008

(30) Foreign Application Priority Data

Mar. 3, 2005 (JP) ..... 2005-058573
Aug. 29, 2005 (JP) ..... 2005-247310

(51) Int. Cl.
*H01P 3/00* (2006.01)
*H01P 3/12* (2006.01)
*H01P 1/00* (2006.01)
*H01P 1/08* (2006.01)

(52) U.S. Cl. ..... 333/208; 333/239; 333/248; 333/252

(58) Field of Classification Search ..... 333/208, 333/209, 239, 248, 252
See application file for complete search history.

(56) References Cited

FOREIGN PATENT DOCUMENTS

| | | |
|---|---|---|
| JP | 59-214303 | 12/1984 |
| JP | 60-25303 | 2/1985 |
| JP | 63-56802 | 4/1988 |
| JP | 63-56802 U | 4/1988 |
| JP | 7-58505 | 3/1995 |
| JP | 2004-289352 | 10/2004 |

OTHER PUBLICATIONS

"Design of Ka Band Highly Selective Wideband Band-Pass Filters Using Directly Coupled Resonant Irises", Rosa-Maria Barrio-Garrido, et al., IEEE Antennas and Propagation Society International Symposium and USNC/CNC/URSI North American Radio Science Meeting, Columbus, Ohio, Jun. 22-27, 2003.

*Primary Examiner*—Robert Pascal
*Assistant Examiner*—Kimberly E Glenn
(74) *Attorney, Agent, or Firm*—Morgan Lewis & Bockius LLP

(57) ABSTRACT

A waveguide and an attenuation pole waveguide bandpass filter with a simple structure without any additional structure such as a negative cross coupling between resonators.

The attenuation pole waveguide bandpass filter arranged at right angle to the longitudinal direction (radio wave propagation direction) is composed only of conductors. The conductor comprises depressions each opening outwardly and having a non-conducting region which continues from the inside of the opening section to the outside, and a window in the conductor section between these opposed depressions. In an alternative embodiment, such conductor shall be covered by a dielectric such as a resin.

9 Claims, 21 Drawing Sheets

(a) FIRST ANTIRESONANCE (REFLECT)

(b) SECOND ANTIRESONANCE (REFLECT)

CONDUCTOR

DIELECTRIC

WAVEGUIDE AND ATTENUATION POLE WAVEGUIDE BANDPASS FILTER

BACKGROUND OF THE INVENTION

1. Field of the Invention

The present invention relates to a waveguide having an attenuation pole waveguide bandpass filter, and more particularly relates to a waveguide having an attenuation pole waveguide bandpass filter to improve skirt characteristics of passband.

2. Description of the Related Art

Conventionally, attenuation pole waveguide bandpass filters with various shapes and structures have been proposed.

For example, a prior art in Unexamined Japanese Patent Heisei 07-058505 (Laid-open) discloses, as shown in FIG. 22, an attenuation pole waveguide bandpass filter which arranges two or more cylindrical posts 5 along the longitudinal direction of the radio wave propagation direction such that it can determine a center frequency and band width of a passband by varying the intervals between these cylindrical posts 5, the width of the cylindrical posts 5 or the width and height of the waveguide.

Likewise, Unexamined Japanese Patent 2004-289352 (Laid-open) also discloses a waveguide having an input and output structure with attenuation poles. As shown in FIG. 23, this waveguide arranges resonators 12A, 12B and 12C constituting a three component filter inside a generally rectangular dielectric block. Grooves (Irises) are formed between those resonators 12A, 12B and 12C, so that the frequency and bandwidth of the passband can be determined.

In addition, "IEEE Antennas and Propagation Society International Symposium and USNC/CNC/URSI North American Radio Science Meeting Columbus, Ohio" Jun. 22-27, 2003 also discloses an waveguide having attenuation pole waveguide bandpass filters. As shown in FIG. 24, this waveguide has two or more attenuation pole waveguide bandpass filters arranged along the radio wave propagation direction, such that it can determine the passband by changing the type of these attenuation pole waveguide bandpass filters.

SUMMARY OF THE INVENTION

Problem to be Solved by the Invention

Incidentally, a bandpass characteristic of this kind of attenuation pole waveguide bandpass filters has a characteristic of passing not only a resonance frequency P1 at the resonance point but also frequencies of the gentle skirt sections S on both sides of the resonation frequency P1 as shown in FIG. 25. In FIG. 25, the vertical axis indicates the passage (dB) and the lateral axis indicates the passband frequency.

Therefore, in order to narrow a passband, it is preferable to increase the falling rate in these skirt sections S as much as possible. However, other than couplings with adjoining resonators, conventionally, for narrowing the passband as mentioned above, an additional coupling structure such as a generation of negative cross coupling between resonators needs to be adopted by adjusting the intervals of cylindrical posts. However, this type of structure has problems such as increasing a structural complexity of the whole filter and also not allowing to effectively make the skirt sections S fall.

Thus the present invention was derived from focusing attention on the above described problems. The purpose of the present invention is to provide a waveguide with an attenuation pole waveguide bandpass filter which allows to effectively increase the falling rate of the skirt sections without requiring any additional structures such as a negative cross coupling between resonators.

Means of Solving the Problems

In order to solve the above described problems, the present invention uses a waveguide comprising attenuation pole waveguide bandpass filters that are positioned at right angle to the radio wave propagation direction, and the attenuation pole waveguide bandpass filter is composed of a conductor, comprised such that the conductor is further comprising two or more depressions each opening outwardly, a window located between these depressions, and rounding sections which go around the end section from the inside of said depression.

As an embodiment of the present invention, a configuration having depressions 410, a window 420 and rounding sections 411 is considered as shown in FIG. 1. When a radio wave is propagated in a waveguide with this configuration, a magnetic current circuit (resonator C1) can be formed at each rounding section 411 which goes around each end section of the depressions 410, therefore allowing to determine the resonance frequency. In addition, current circuits (a first antiresonance circuit C2 and a second antiresonance circuit C3) can be formed in the conductor section around the window 420 and the conductor section around the depressions 410 respectively, such that the skirt sections S are allowed to increase its falling rate, thus narrowing the range of the passband.

As an embodiment of the present invention, an attenuation pole waveguide bandpass filter is composed only of a plate-like conductor and is sandwiched at the joint between waveguide components.

Such as this configuration allows to form an attenuation pole waveguide bandpass filter only by cutting a metal plate, thus significantly improving the manufacturing efficiency. Moreover, it consists of only conductors so that it can reduce the insertion loss to radio wave, thus achieving a higher peak at the resonance frequency.

As an alternative embodiment, the rounding sections of such a conductor may be covered with a resin.

Even in the case that the conductor is covered by a resin as above, when conducting radio wave through the waveguide, it can also increase the falling rate on both sides of the resonance frequency determined by the magnetic current circuit, thus allowing to narrow the passband. Moreover, since the conductor is surrounded by a resin, it can easily be attached to any part of the cavity in the waveguide.

In a preferred embodiment of the present invention, two or more attenuation pole waveguide bandpass filters with different bandpass characteristics are arranged along the radio wave propagation direction of the waveguide.

Normally, if only one attenuation pole waveguide bandpass filter is provided, then after forming a gain fall once, the passage rate will in turn recover in the frequency ranges on both sides of the fall, however if other attenuation pole waveguide bandpass filters are provided at places where such a passage rate recovery occurs, it can suppress the recovery of the passage rate, thus allowing to further narrow the passband.

When such an attenuation pole waveguide bandpass filter is configured, depressions and windows shall be formed in a vertically and laterally symmetrical shape.

In addition, cut-off guides are provided to narrow the width in the vertical direction to the radio wave propagation direction, and then an attenuation pole waveguide bandpass filter is to be attached between the opposed cut-off guides.

As a result, the narrow passage between the opposed cut-off guides can shorten the wavelength of the radio wave, thus the interval length λ/4 between the attenuation pole waveguide bandpass filters can be shortened.

ADVANTAGEOUS EFFECT OF THE INVENTION

The present invention uses a waveguide comprising attenuation pole waveguide bandpass filters that are positioned at right angles to the radio wave propagation direction, and each attenuation pole waveguide bandpass filter is composed of a conductor, comprised such that the conductor is further comprising two or more depressions each opening outwardly, a window located between these depressions, and rounding sections which go around the end section from the inside of said depression, therefore when a radio wave is propagated through the waveguide, it can form a magnetic current circuit at each rounding section going around each depression from outside to inside, and also forms a current circuit in the conductor section around the window and the conductor section around the depressions. By this means, the falling rate of the skirt sections near the resonance frequency can be increased by the current circuit, thus narrowing the range of the passband.

DESCRIPTION OF SYMBOLS

Figure 1:
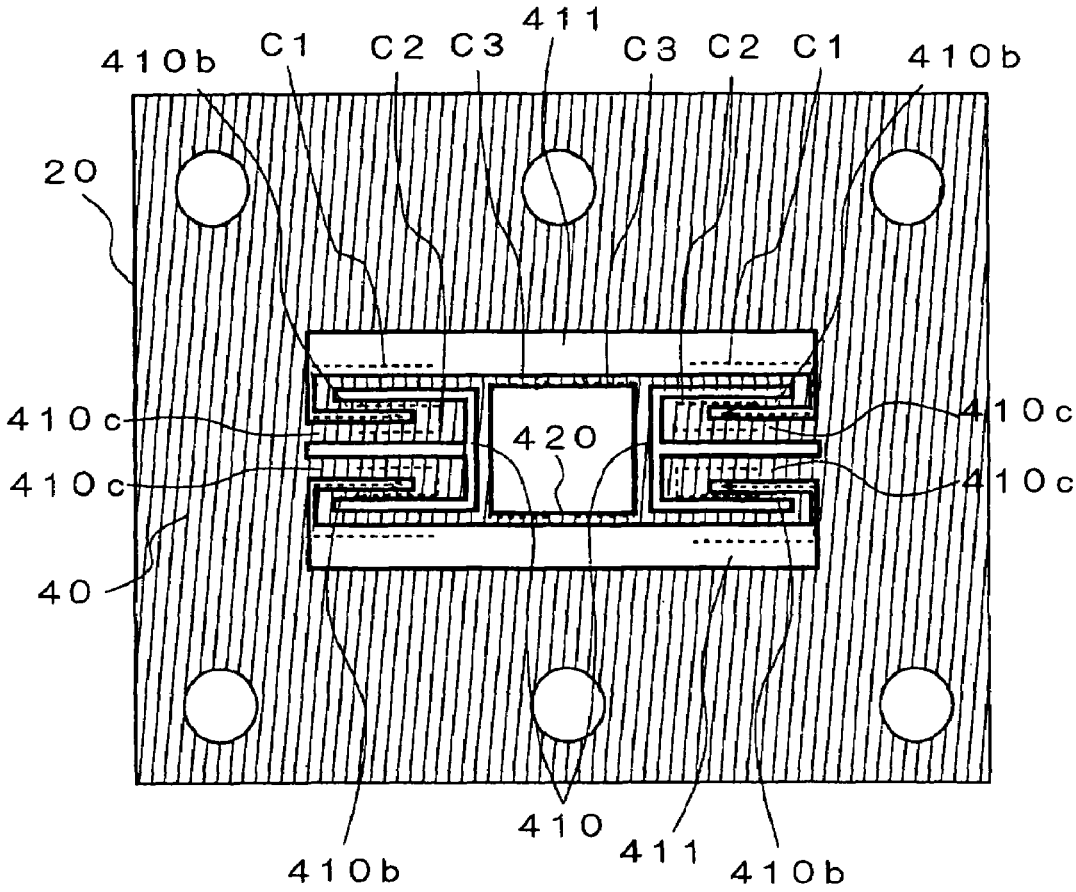
FIG. 1 shows a configuration of an attenuation pole waveguide bandpass filter according to Embodiment 1 of the present invention.

1, 10 waveguide
10*a* waveguide component
10*b* flange part
2, 20 attenuation pole waveguide bandpass filter
3 dielectric
4, 40 conductor
41, 410 depression
41*a* bottom
410*b* incoming section
410*c* return section
41*b* opening end
42, 420 window
P1 resonance frequency
P2 first antiresonance frequency
P3 second antiresonance frequency
C1 resonator
C2 first antiresonance circuit
C3 second antiresonance circuit
S skirt section

DETAILED DESCRIPTION OF THE INVENTION

EMBODIMENT 1

Figure 2:
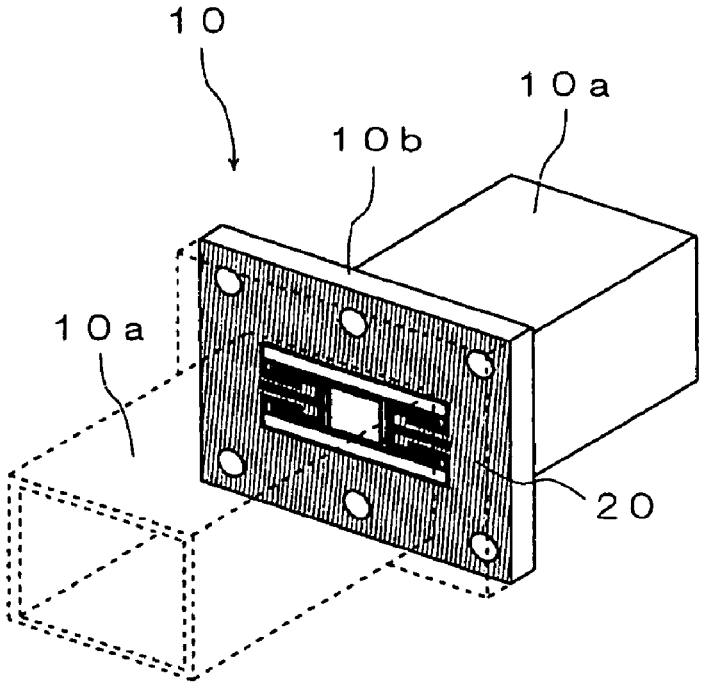
FIG. 2 is an illustration showing a state that an attenuation pole waveguide bandpass filter of FIG. 1 is attached to a waveguide.

Referring to drawings, Embodiment 1 of the present invention is described hereinafter. FIG. 1 shows a structure of an attenuation pole waveguide bandpass filter 20 which will be attached to a waveguide, and FIG. 2 shows a waveguide 10 to which the attenuation pole waveguide bandpass filter 20 has been attached. FIG. 3 to FIG. 10 show the bandpass characteristics for various attenuation pole waveguide bandpass filters 20.

As shown in FIG. 1, an attenuation pole waveguide bandpass filter 20 of Embodiment 1 is composed of a window 420 located in the center of a thin plate-like conductor 40, depressions 410 provided on both sides of the window, rounding sections 411 which go around the end section from the inside of the depression 410. The window 420 is formed by cutting out a rectangle into the conductor 40 and the inside part thereof is used as a hollow non-conducting region. Likewise, the depressions 410 and the rounding sections 411 are formed by cutting out the conductor 40, and while forming a cutout portion in a groove shape, further a cutout portion is formed from the inside of the depression 410 going around the end section. Thus the conductor manufactured by the above cutting out is made to form the incoming sections 410*b* which come from the outside to the inside of the opening of each depression 410, and the return sections 410*c* which in turn return to each opening from the incoming sections 410*b*.

The attenuation pole waveguide bandpass filter 20 formed as above is attached in a way that it is sandwiched at the flange part 10*b* formed at the joint between divided waveguide components 10*a*, thus allowing to form the waveguide 10 having predetermined bandpass characteristics.

In this embodiment, the depressions 410, rounding sections 411 and window 420 are provided as the borders of the conductor 40 and the non-conducting region.

When a radio wave propagates in the longitudinal direction of the waveguide 10 having the attenuation pole waveguide bandpass filter 20, a resonator C1 is formed by the magnetic current within the non-conducting region in each rounding section 411 of the attenuation pole waveguide bandpass filter 20, thus the passband of the waveguide 10 can be determined by this resonator C1.

In addition, an electric current is generated in the conducting region near the depressions 410 and the window 420 so that the first antiresonance circuit C2 and the second antiresonance circuit C3 are formed. This first antiresonance circuit C2 and second antiresonance circuit C3 are to narrow the range of the passband such that the falling rate of the skirt sections on both sides of the bandpass characteristics will be increased by the first antiresonance circuit C2 and the second antiresonance circuit C3. This first antiresonance circuit C2 is formed by an electric current going through the inside of each depression 410 allocated on both sides, that is the incoming section 410*b* and the return section 410*c*, and the second antiresonance circuit C3 is formed by an electric current circling the conductor section of the window 420 allocated in the middle.

The bandpass characteristics based on these resonator C1 and antiresonance circuits (the first antiresonance circuit C2 and the second antiresonance circuit C3) are determined by the size and other factors of the depressions 410 and the window 420 of the conductor 40. These states are shown in details in FIG. 3 to FIG. 10.

In FIG. 3 to FIG. 10, the lateral axis indicates the passband frequency and the vertical axis indicates the passage (dB). When the passage (dB) equals to zero in the vertical axis, it means that all radio wave at the frequency passes through.

Figure 3:
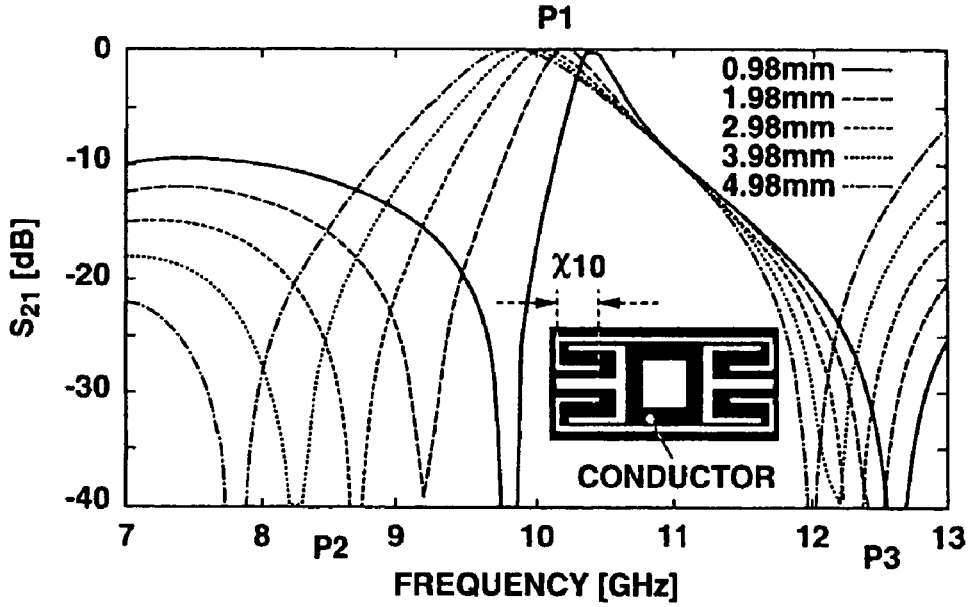
FIG. 3 shows bandpass characteristics of an attenuation pole waveguide bandpass filter with the same configuration except that the length of the return section is changed.

FIG. 3 shows bandpass characteristics when the longitudinal length of the incoming section 410*c* of the conductor 40 is changed. In FIG. 3, assuming the size of the incoming section 410*c* is set to X10, as X10 increases the resonance frequency P1, the first antiresonance frequency P2 and the second antiresonance frequency P3 will shift to lower frequencies, particularly only the first antiresonance frequency P2 will remarkably shift to a lower frequency. Therefore it is understood that the size X10 of the incoming section 410*c* is a key factor to determine the first antiresonance frequency P2.

Figure 4:
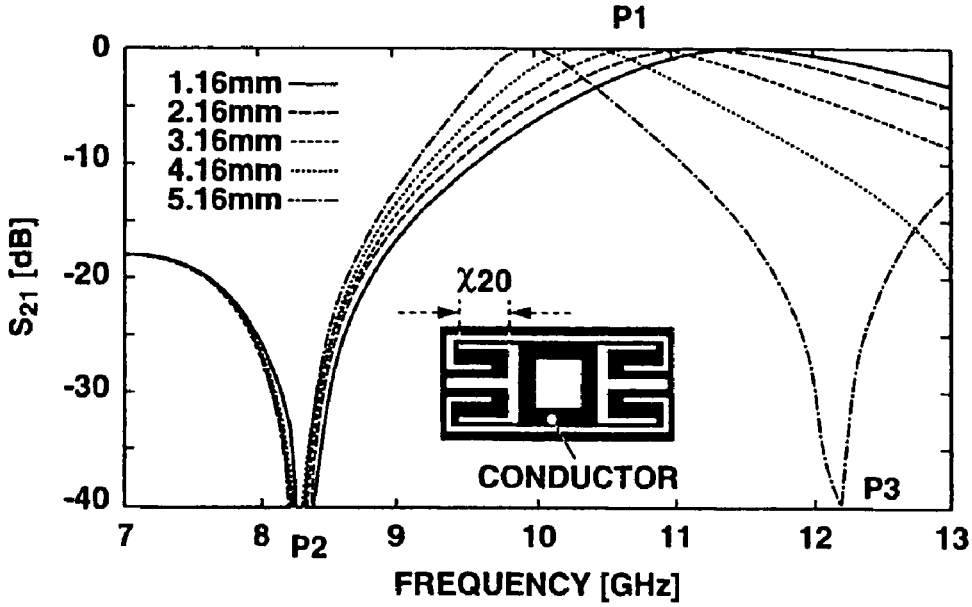
FIG. 4 shows bandpass characteristics of an attenuation pole waveguide bandpass filter with the same configuration except that the length of the incoming section is changed.

FIG. 4 shows a variation of the bandpass characteristics when the longitudinal length of the return section 410*b* of the conductor 40 is changed. Even though the longitudinal length X20 of the return section 410*b* increases, the first antiresonance frequency P2 will not change as much, however the resonance frequency P1 will shift to a lower frequency and the second antiresonance frequency P3 will have an even greater shift to a lower frequency. Therefore, the longitudinal length X20 of the return section 410*b* is a key factor to determine the resonance frequency P1 and the second antiresonance frequency P3.

Figure 5:
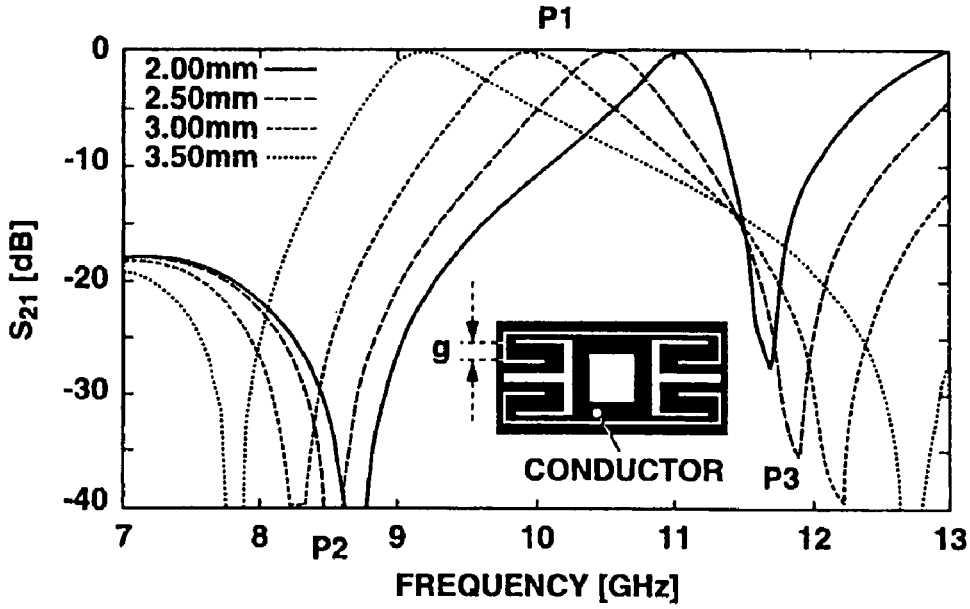
FIG. 5 shows bandpass characteristics of an attenuation pole waveguide bandpass filter with the same configuration except that the width of the incoming section is changed.

FIG. 5 shows bandpass characteristics when the width of the return section 410*b* is changed. When the width g of the return section 410*b* increases, the resonance frequency P1 and the first antiresonance frequency P2 will shift to a lower frequency, however the second antiresonance frequency P3 will contrarily shift to a higher frequency as the width g of the return section 410*b* increases.

Figure 6:
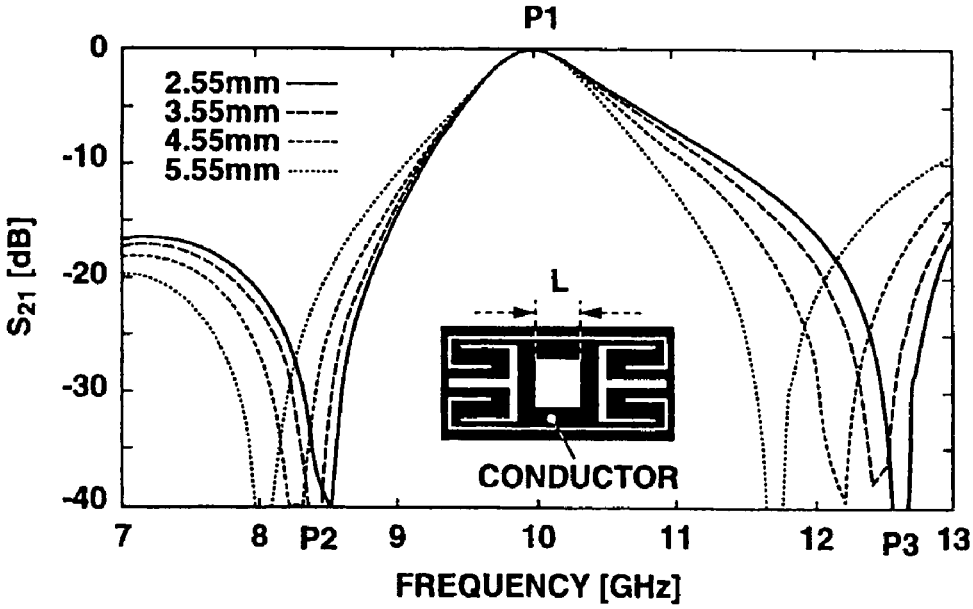
FIG. 6 shows bandpass characteristics of an attenuation pole waveguide bandpass filter with the same configuration except that the lateral width of the window is changed.

On the other hand, FIG. 6 shows bandpass characteristics when the lateral width L of the window 420 is changed. As shown in FIG. 6, even though the lateral width L of the window 420 increases, the resonance frequency P1 hardly shows a variation. This is because an increase of the lateral width L of the window 420 will not cause any major alterations to the magnetic current circuits of the rounding sections 411. However, when the lateral width L of the window 420 increases, the first antiresonance frequency P2 and the second antiresonance frequency P3 significantly shift to lower frequencies. Therefore, the lateral width L of the window 420 is an important factor to determine the first antiresonance frequency P2 and the second antiresonance frequency P3.

Figure 7:
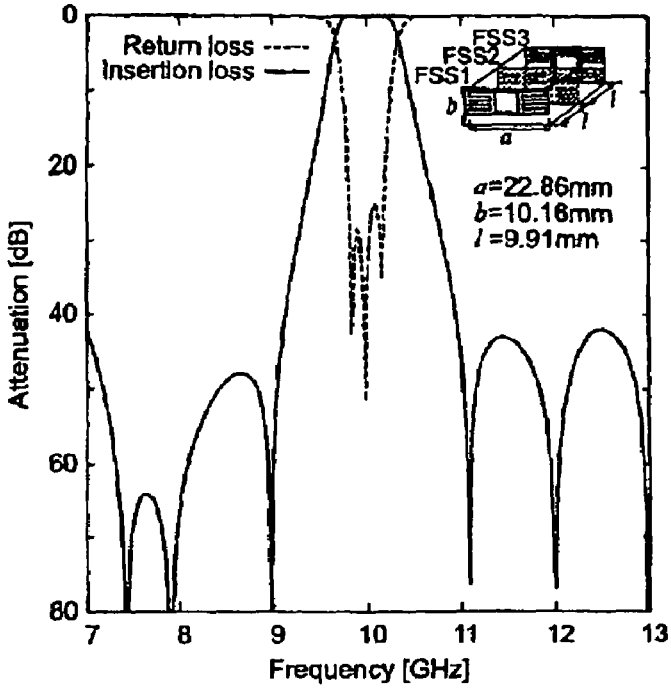
FIG. 7 shows bandpass characteristics of a waveguide in which three different attenuation pole waveguide bandpass filters with the same configuration are arranged.
Figure 8:
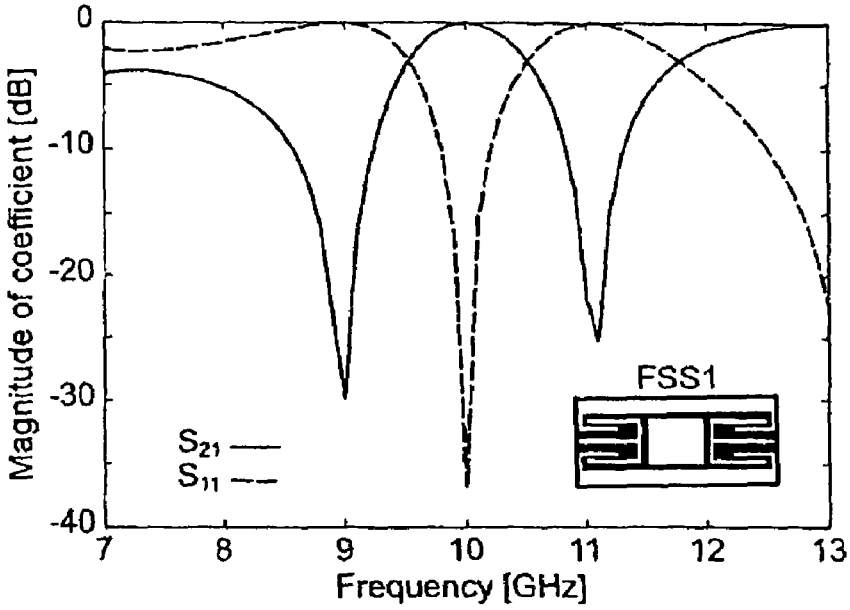
FIG. 8 shows bandpass characteristics of one of the attenuation pole waveguide bandpass filters used in FIG. 7.
Figure 9:
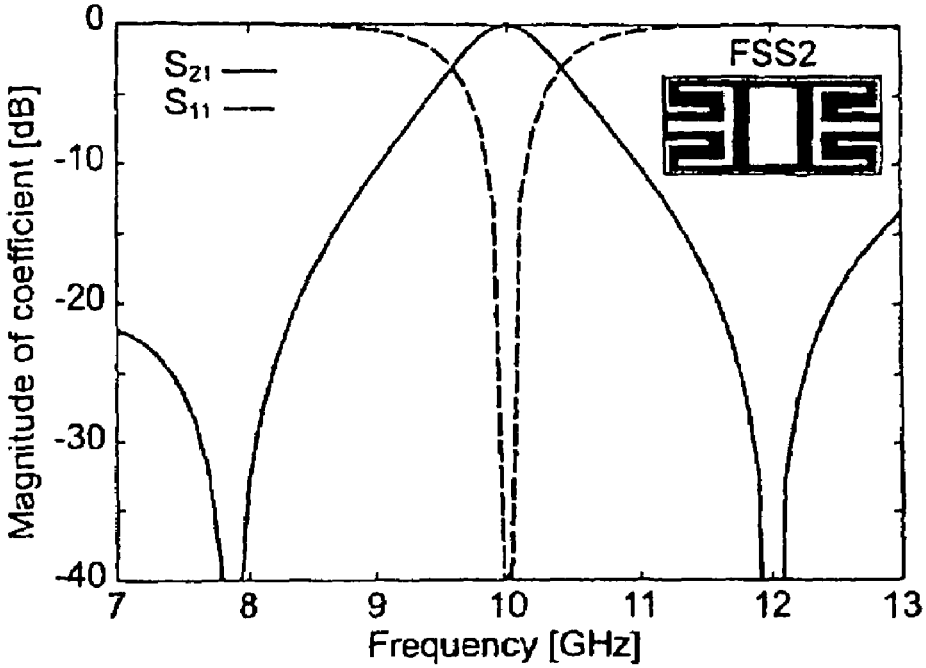
FIG. 9 shows bandpass characteristics of one of the attenuation pole waveguide bandpass filters used in FIG. 7.
Figure 10:
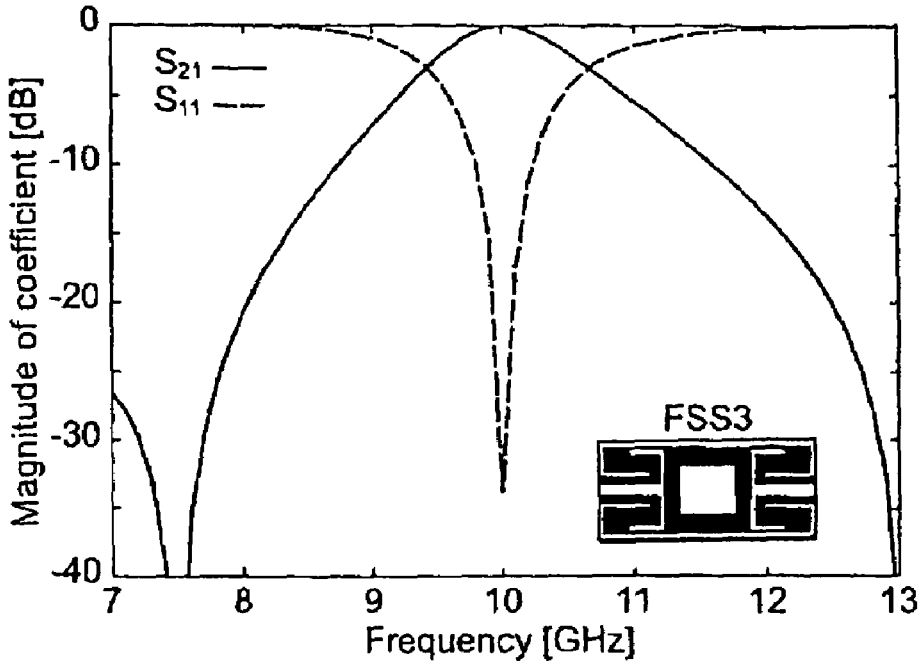
FIG. 10 shows bandpass characteristics of one of the attenuation pole waveguide bandpass filters used in FIG. 7.

Then, three kinds of such attenuation pole waveguide bandpass filters 20 are prepared and are attached to the waveguide 10 with an interval of $\lambda/4$ ($\lambda$ is a wavelength of radio wave). FIG. 7 shows bandpass characteristics of the waveguide 10 which has two or more attenuation pole waveguide bandpass filters 20 attached. Each attenuation pole waveguide bandpass filter 20 attached to this waveguide 10 has bandpass characteristics shown in FIG. 8 to FIG. 10, respectively. Each has the same resonance frequency P1 and each has a different first antiresonance frequency P2 and a different second antiresonance frequency P3.

When these three attenuation pole waveguide bandpass filters 20 are attached with an interval of $\lambda/4$, the characteristics corresponding to each attenuation pole waveguide bandpass filter 20 are added and three of the first antiresonance frequencies P2 and the second antiresonance frequencies P3 emerge on both sides of the resonance frequency P1. If only one plate of attenuation pole waveguide bandpass filter 20 is used, the characteristic recovers on both sides of the first resonance frequency P2 and second resonance frequency P3, thus allowing the frequencies within the ranges to pass through. However, if other attenuation pole waveguide bandpass filters 20 respectively having a first resonance frequency P2 and a second resonance frequency P3 in the recovery ranges are placed, such a recovery can be suppressed. Therefore, the passband can be made narrower than those of conventional types.

EMBODIMENT 2

Figure 11:
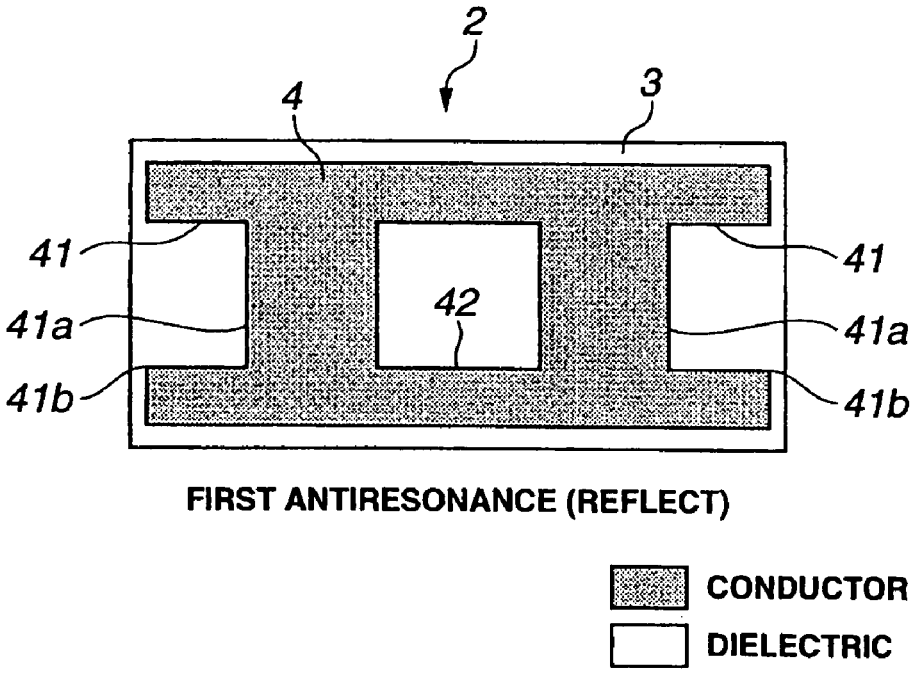
FIG. 11 shows a configuration of an attenuation pole waveguide bandpass filter according to Embodiment 2 of the present invention.
Figure 12:
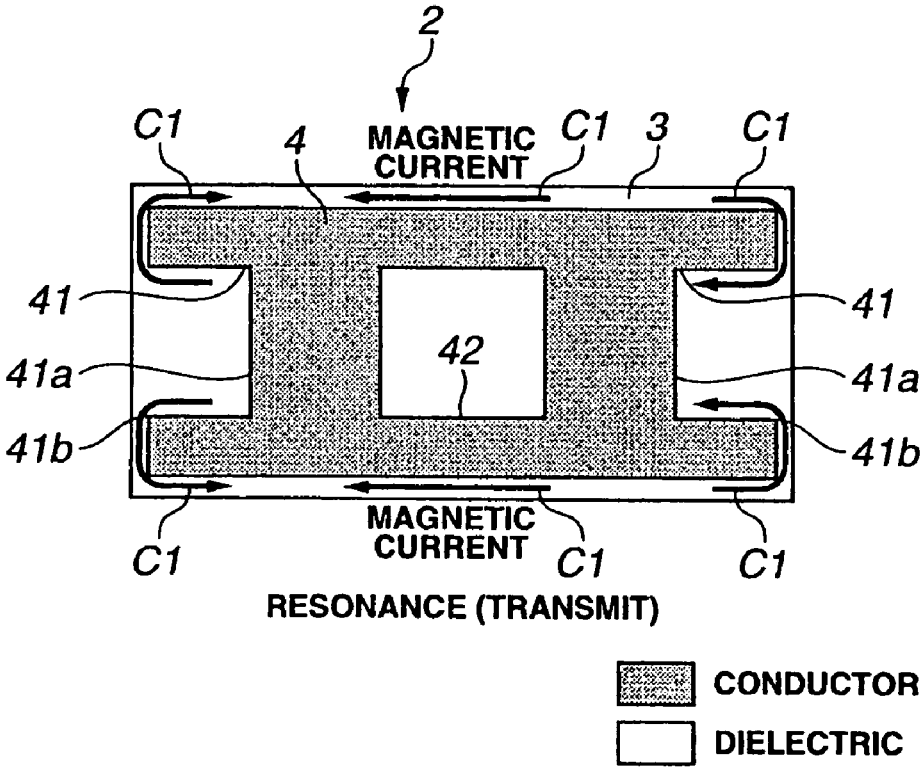
FIG. 12 is an illustration of magnetic current distribution of a resonator in the same configuration.
Figure 13A:
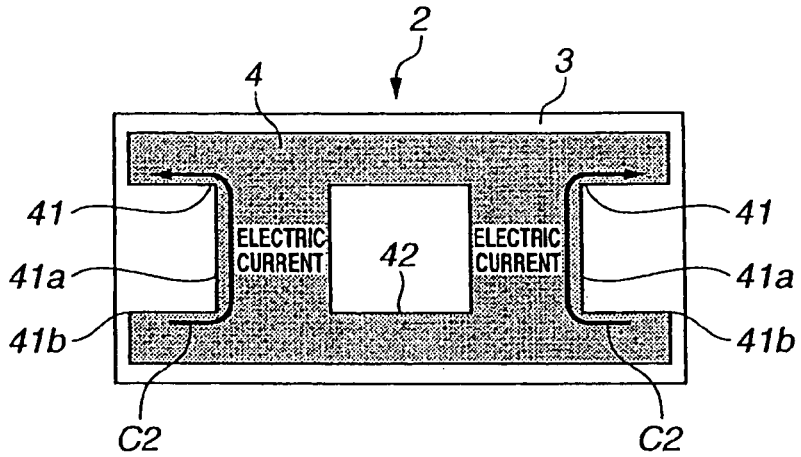
FIG. 13A and FIG. 13B show illustrations of electric current distribution of a first antiresonance circuit and second antiresonance circuit in the same configuration.
Figure 13B:
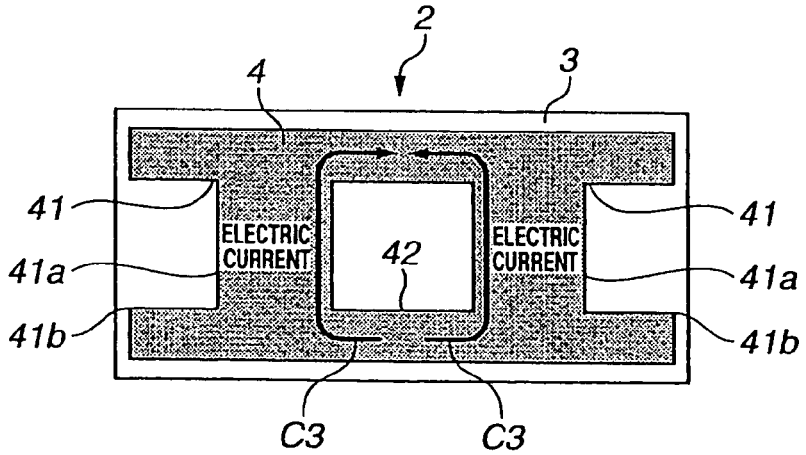
Figure 14:
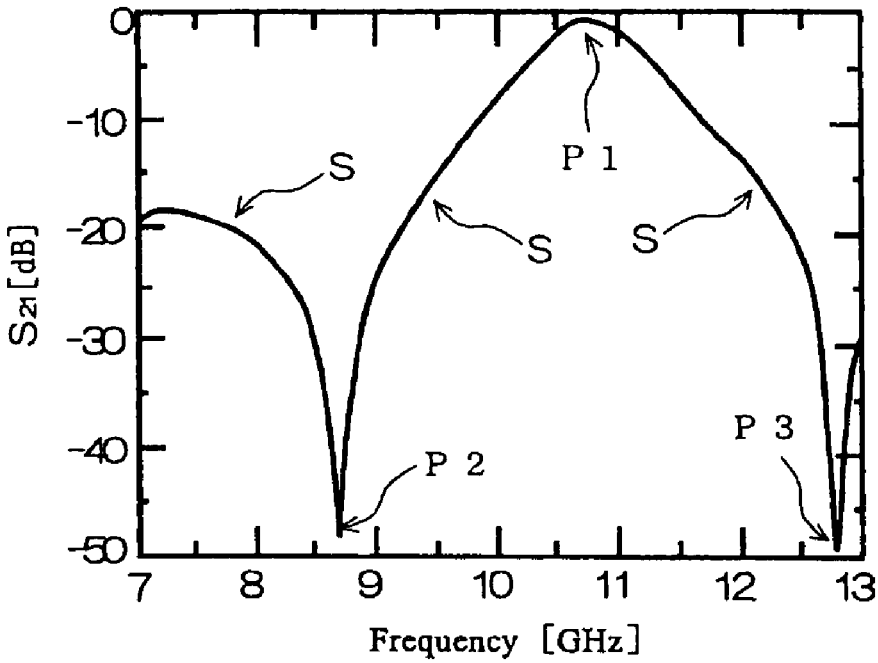
FIG. 14 shows a general bandpass characteristic in the same configuration.

Secondly, in Embodiment 2 of the present invention, a waveguide 1 using attenuation pole waveguide bandpass filter 2 is described. FIG. 11 shows a typical structure of an attenuation pole waveguide bandpass filter 2 which will be attached to the waveguide 1, and FIG. 12 shows a magnetic current distribution of a resonator C1 in the attenuation pole waveguide bandpass filter 2, and FIG. 13A and FIG. 13B show electric current distributions of antiresonance circuits (the first antiresonance circuit C2 and the second antiresonance circuit C3). In addition, FIG. 14 shows bandpass characteristics by the attenuation pole waveguide bandpass filter 2.

Figure 19:
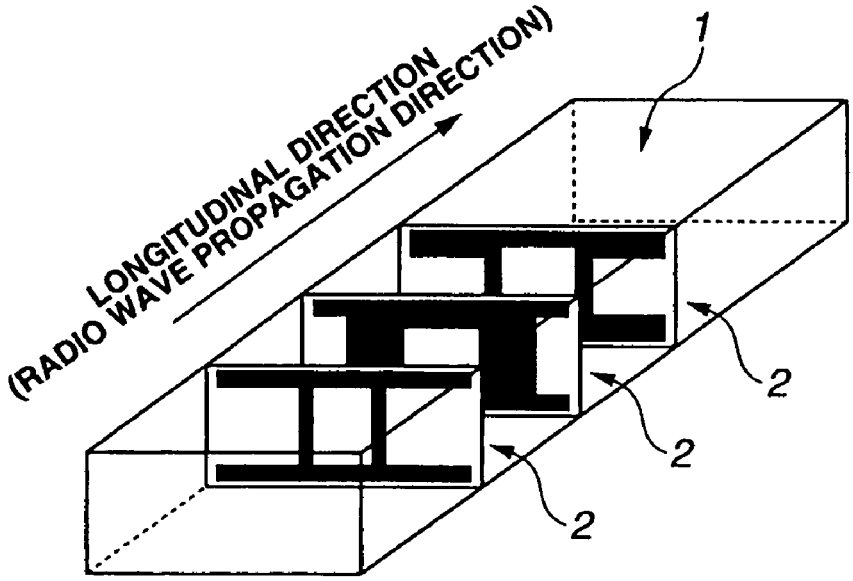
FIG. 19 is an illustration showing a waveguide in which attenuation pole waveguide bandpass filters with the same configuration are mounted.

The attenuation pole waveguide bandpass filters 2 of this embodiment are configured to be attached in a way it is inserted into the hollow section of a narrow rectangular waveguide 1 as shown in FIG. 19, and are attached at right angle to the longitudinal direction of the radio wave propagation direction.

The attenuation pole waveguide bandpass filter 2 is composed of a thin filter which is configured by molding a conductor 4 with a dielectric 3. This conductor 4 is configured to have two depressions 41 opening towards left and right respectively and a rectangular window 42 located in the middle of these two depressions 41. Then, a dielectric 3 is provided at the top and bottom surfaces of this conductor 4 and inside the depressions 41 and the window 42. Although resin is generally used for this dielectric 3, different types of resins may be used in places. For example, it is considered that a first resin is filled inside the window 42 and the surrounding section of the depressions 41 is covered by a second resin.

In this embodiment, the resonator C1 is formed by a magnetic current generated in this dielectric 3, and the first antiresonance circuit C2 and the second antiresonance circuit C3 are formed by an electric current flowing in the conductor 4. This resonator C1 is formed by a magnetic current circuit going around the dielectric 3 of each depression 41 and determines the band frequency passing through the waveguide 1.

Moreover, the first antiresonance circuit C2 and the second antiresonance circuit C3 are to narrow the range of the passband such that the falling rate of the skirt sections on both sides of the bandpass characteristics will be increased by the first antiresonance circuit C2 and the second antiresonance circuit C3. This first antiresonance circuit C2, as shown in FIG. 13A, is formed by an electric current generated in the conductor section close to each depression 41 configured symmetrically on both sides. Also the second antiresonance circuit C3, as shown in FIG. 13B, is formed by an electric current generated in the conductor section near the window 42 configured in the middle.

The bandpass characteristics in these resonator C1 and antiresonance circuits (the first antiresonance circuit C2 and the second antiresonance circuit C3) are determined by the sizes and other factors of the depressions 41 and the window 42 of the conductor 4. This state is shown in detail in FIG. 15 to FIG. 18.

Figure 15:
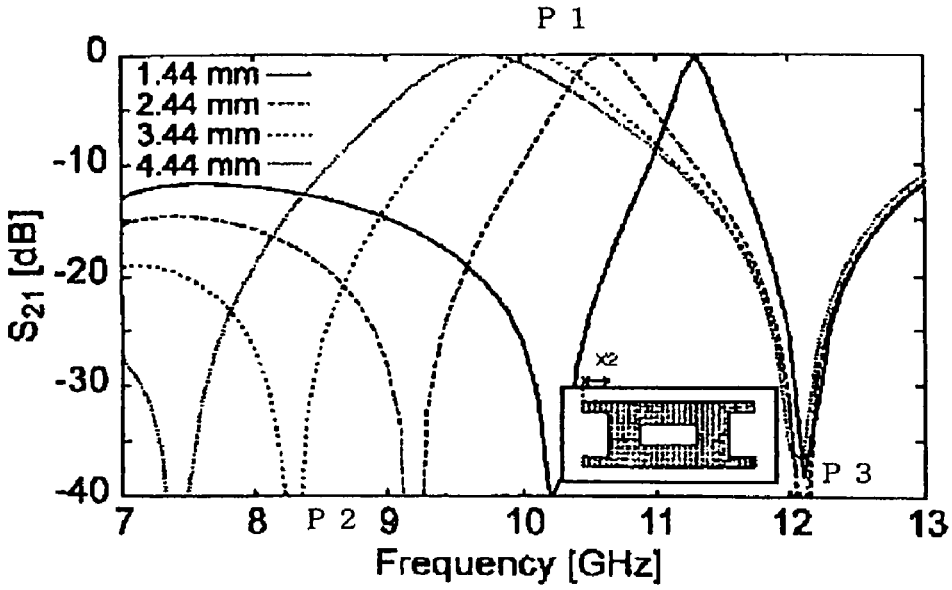
FIG. 15 shows bandpass characteristics with various lateral lengths of the depressions in the same configuration.
Figure 16:
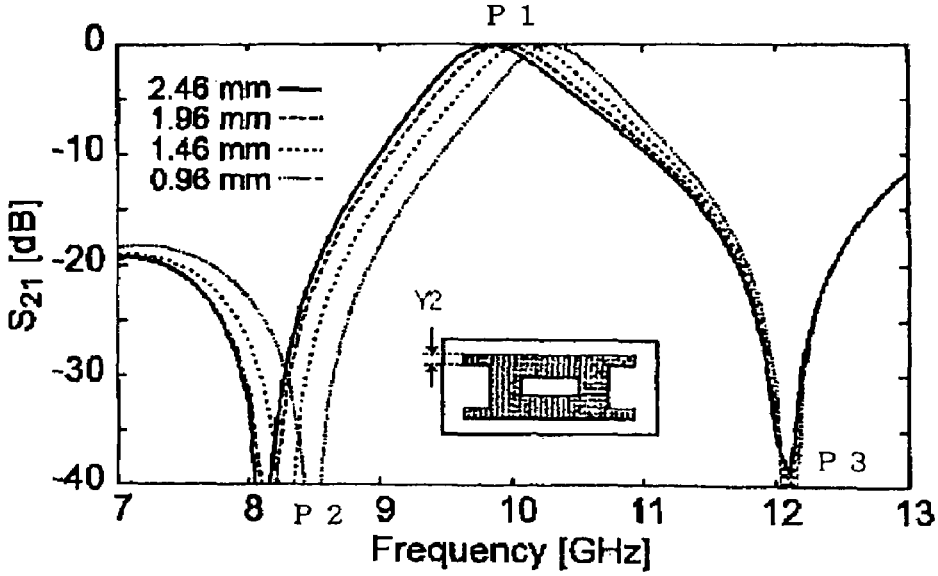
FIG. 16 shows bandpass characteristics with various vertical lengths of the depressions in the same configuration.

In FIG. 15 and FIG. 16, the lateral axis indicates the passband frequency and the vertical axis indicates the passage (dB) in the same way as Embodiment 1. When this passage (dB) equals to zero, it means that all radio wave at the frequency passes through. In FIG. 15, assuming that the distance from the bottom 41*a* of the depression 41 to the opening end 41*b* is set to X2, as X2 increases, the resonance frequency P1 will shift to a lower frequency and also the first antiresonance frequency P2 will have a greater shift to a lower frequency. On the other hand, the second antiresonance frequency P3 will not be significantly altered by a change in X2. Therefore, the distance X2 from the bottom 41*a* of the depression 41 to the opening end 41*b* is a key factor to determine the resonance frequency P1 and the first antiresonance frequency P2.

Next, assume that the width of each conductor 4 located in the top and bottom of the depressions 41 is set to Y2. FIG. 16 shows the bandpass characteristics when Y2 varies. According to the graph in FIG. 16, when Y2 decreases, the resonance frequency P1 and the first antiresonance frequency P2 will slightly shift to higher frequencies. However, since this amount of shift is far too small compared to the amount of shift in FIG. 15, Y2 cannot be a key factor to determine the resonance frequency P1 and the first antiresonance frequency P2. In addition, as clearly seen in FIG. 16, even if Y2 varies, the second antiresonance frequency P3 will not be changed, thus Y2 cannot be a key factor to determine the second antiresonance frequency P3.

Figure 17:
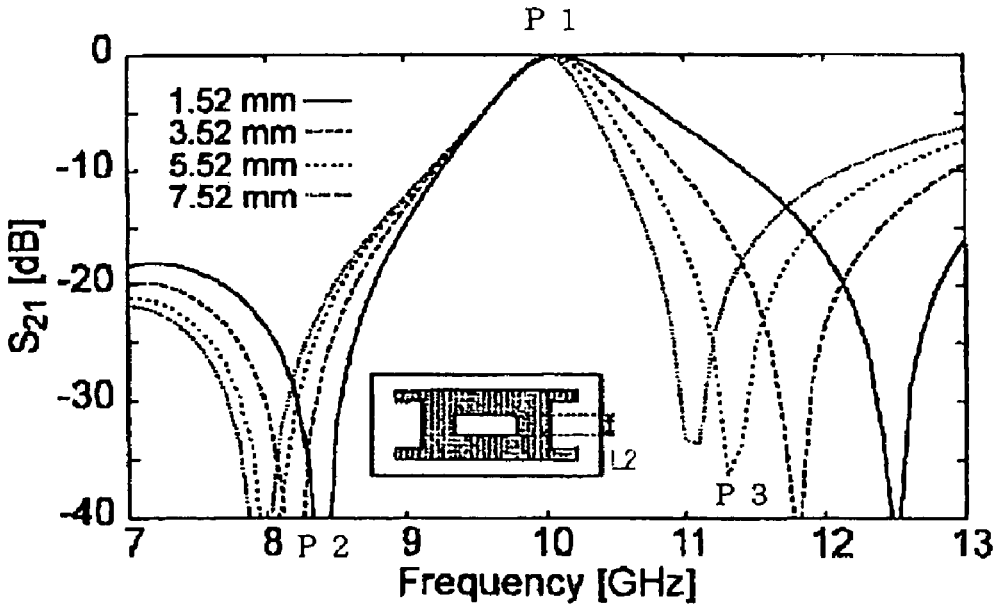
FIG. 17 shows bandpass characteristics with various lateral lengths of the window in the same configuration.

On the other hand, the size of the vertical direction of the rectangular window 42 will affect the first antiresonance frequency P2 and the second antiresonance frequency P3. This state is shown in FIG. 17. First, in FIG. 17, if the inner size of the vertical direction of the window 42 is set to L2, an increase of L2 will hardly change the resonance frequency P1. However, the first antiresonance frequency P2 will shift to a lower frequency and the second antiresonance frequency P3 will have an even greater shift to a lower frequency. Therefore, the vertical width L2 of the rectangular window 42 is a key factor to determine the first antiresonance frequency P2 and the second antiresonance frequency P3.

Figure 18:
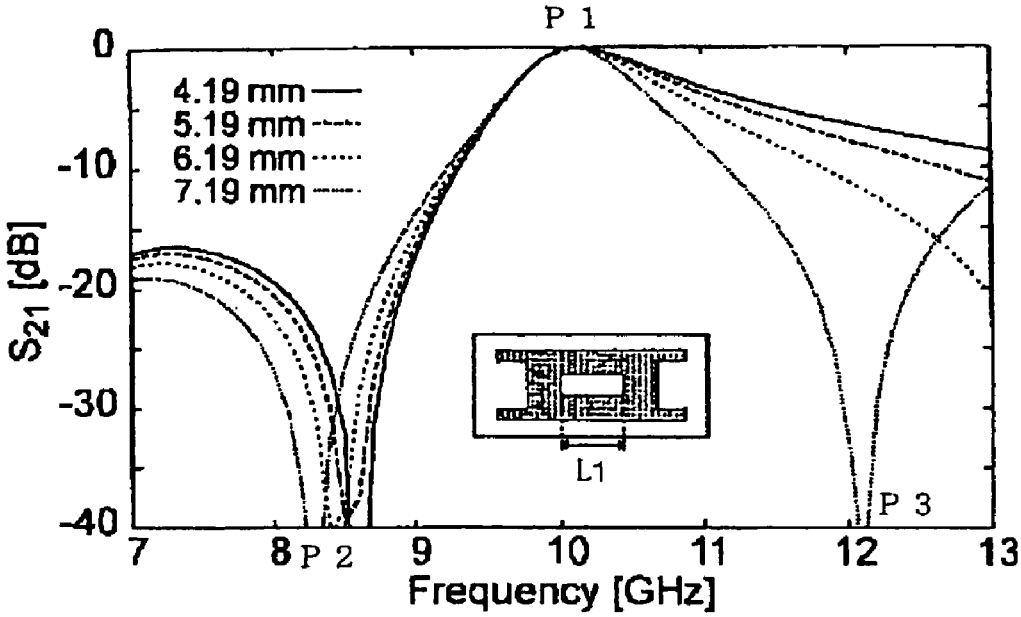
FIG. 18 shows bandpass characteristics with various vertical lengths of the window in the same configuration.

Next, FIG. 18 shows a state when the inner size L1 in the lateral direction of the rectangular window 42 is changed. As shown in the graph in FIG. 18, even though the lateral width L1 of the window 42 increases, the resonance frequency P1 hardly shows a variation. In addition, when L1 increases, the first antiresonance frequency P2 will slightly shift to a lower frequency, however the amount of the shift is very small compared to the amount of the shift in FIG. 15. On the other hand, when L1 increases, the second antiresonance frequency P3 will have a significant shift to a lower frequency. In this case, if the size of L1 is small, the second antiresonance frequency P3 will become too high, thus the skirt sections are too gentle and allow almost all radio wave in higher frequency range to pass through. Therefore, in order to narrow the range of the passband, it is preferable not to set L1 too small.

Therefore, in a comprehensive manner, when a resonance frequency P1 is to be determined, the distance X2 from the bottom 41*a* of the depression 41 to the opening end 41*b* shall be used, and likewise when a first antiresonance frequency P2 is to be determined, the distance X2 from the bottom 41*a* of the depression 41 to the opening end 41*b*, the vertical length Y2 of the depression 41 or the vertical width L2 of the window 42, etc. shall be used. In addition, when a second antiresonance frequency P3 is to be determined, it is preferable to use the vertical width L2 of the window 42 or the lateral width L1 of the window 42.

Figure 21:
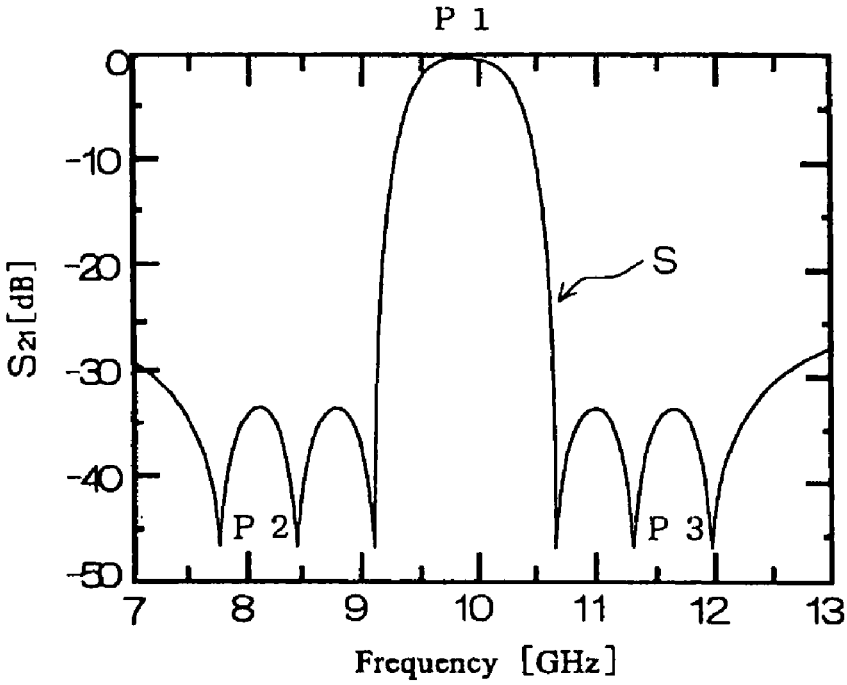
FIG. 21 shows a bandpass characteristic of FIG. 19.
Figure 22:
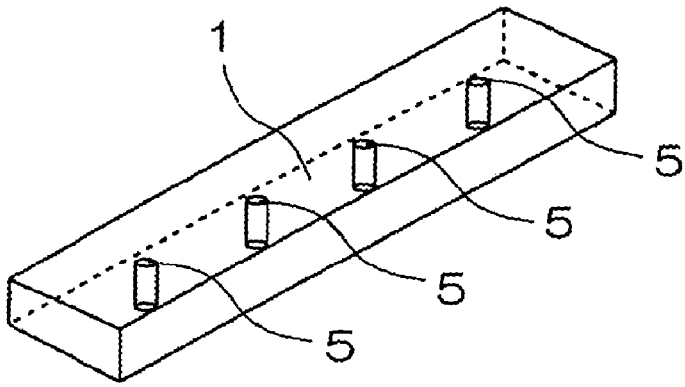
FIG.22 Conventional Art
FIG. 22 is an illustration showing an attenuation pole waveguide bandpass filter of a conventional example.
Figure 23:
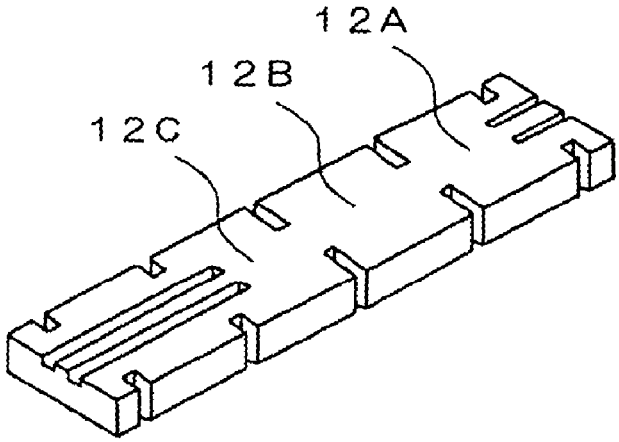
FIG.23 Conventional Art
FIG. 23 is an illustration showing an attenuation pole waveguide bandpass filter of a conventional example.
Figure 24:
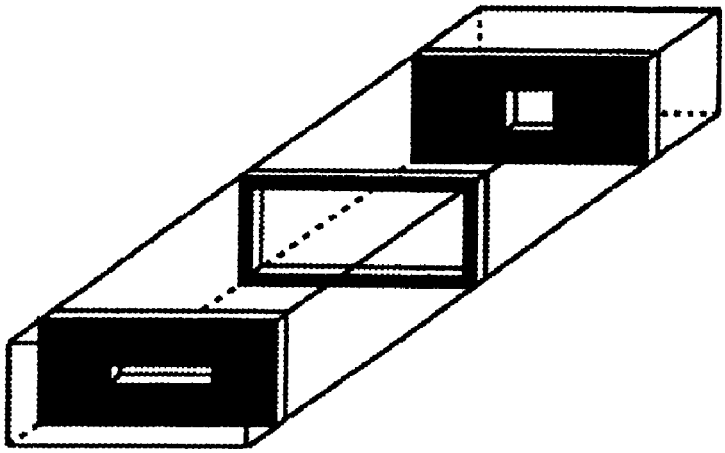
FIG.24 Conventional Art
FIG. 24 is an illustration showing an attenuation pole waveguide bandpass filter of a conventional example.
Figure 25:
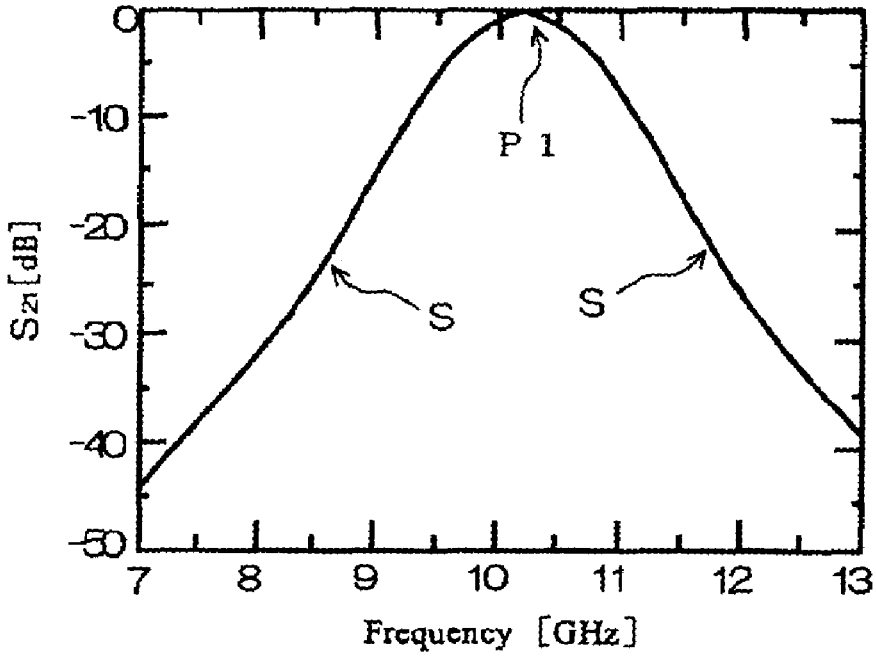
FIG.25 Conventional Art
FIG. 25 shows a bandpass characteristic of a general attenuation pole waveguide bandpass filter.

When attenuation pole waveguide bandpass filters configured as above are attached to a waveguide 1, two or more attenuation pole waveguide bandpass filters 2 with different bandpass characteristics are arranged in a predetermined interval as shown in FIG. 19. This arrangement interval is set to be $\lambda/4$ of the center frequency. However, when two or more kinds of such attenuation pole waveguide bandpass filters 2 are attached, each filter that is used shall have a common resonance frequency P1 and also have a first antiresonance frequency P2 and a second antiresonance frequency P3 which are different from those for others. Generally, if one plate of attenuation pole waveguide bandpass filter 2 is used, the passing frequency recovers to pass in outer ranges of the first antiresonance frequency P2 and the second antiresonance frequency P3, which allows the frequency in the range to pass through. However, if another attenuation pole waveguide bandpass filter 2 having a first antiresonance frequency P2 and a second antiresonance frequency P3 in such recovery ranges is configured, two or more antiresonance frequency points are provided such that the recovery can be suppressed as shown in FIG. 21. Therefore the passband can be narrower than those of conventional types.

Figure 20:
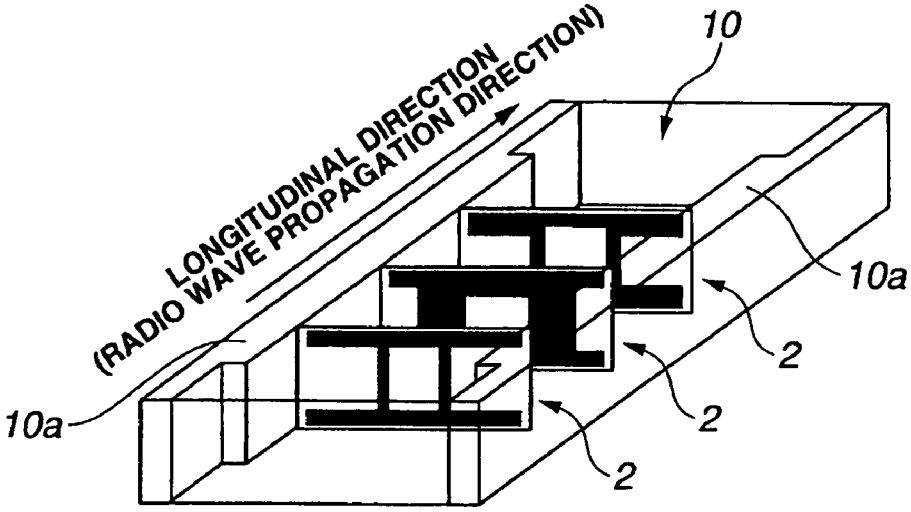
FIG. 20 is an illustration showing a waveguide of another embodiment with the same configuration.

In addition, a waveguide 1*a* of another embodiment is shown in FIG. 20. The waveguide 1*a* of this embodiment has opposed cut-off guides 1*b* on both sides such that these cut-off guides 1*b* shorten the wavelength of the radio wave which passes through the narrow section. Then, the plurality of different attenuation pole waveguide bandpass filters 2 shall be set in the narrow section. By this means, the wavelength λ of the radio wave becomes shorter allowing to shorten the interval of attenuation pole waveguide bandpass filters 2 arranged by the interval of λ/4, as a result of which the total length of the waveguide 1*a* can be shortened.

In this way, in accordance with the above embodiments, in a waveguide 1, 10 in which attenuation pole waveguide bandpass filters 2, 20 that are at right angle to the radio wave propagation direction are configured, a conductor 4, 40 constituting attenuation pole waveguide bandpass filters 2, 20, comprises a plurality of depressions 41, 410 respectively opening outwardly, a window 42, 420 configured between these depressions 41, 410, and rounding sections 411 which go around the end section from the inside of said depression 41, 410, such that a resonator C1 can be formed at the rounding section 411 going around from the outside to the inside of each depression 410, therefore a resonance frequency can be determined. In addition, a first antiresonance circuit C2 and a second antiresonance circuit C3 can be formed in the conductor section around the window 420 and the conductor section around the depressions 410, such that the skirt sections are allowed to increase its falling rate, thus narrowing the range of the passband.

In Embodiment 1, the attenuation pole waveguide bandpass filters 20 are composed only of plate-like conductors 40, which are inserted in joints between waveguide components 10*a* so that attenuation pole waveguide bandpass filters 20 can be formed only by cutting metal plates, thus significantly improving the manufacturing efficiency. Moreover, it consists of only plate-like conductors 40 so that it can reduce the insertion loss by resin etc. to a radio wave, thus achieving a higher peak at the resonance frequency P1.

In Embodiment 2, such conductors 4 are covered by resin so that these conductors 4 can be inserted into the hollow section of a waveguide 1 allowing to be attached at any places.

Since two or more attenuation pole waveguide bandpass filters 2, 20 with different bandpass characteristics are configured to be arranged, when other attenuation pole waveguide bandpass filters 2, 20 contributing to the falls are provided at places where a passage rate recovery occurs, it can suppress the recovery of the passage rate, thus allowing to further narrow the passband.

In addition, since cut-off guides 1*b* are configured to narrow the width vertical to the radio wave propagation direction and two or more attenuation pole waveguide bandpass filters 2 are provided in a space formed by the opposed cut-off guides 1*b*, thus the cut-off guides 1*b* allows to shorten the wavelength of the radio wave in the narrow section, by this means, the arrangement interval (λ/4) of attenuation pole waveguide bandpass filters 2 can be shortened.

The present invention is not intended to be limited to the above embodiments and can be implemented in various forms.

That is, although the attenuation pole waveguide bandpass filter 2 is composed of a single plate of conductor 4 in the above described embodiments, this may be configured by a plurality of plates. For example, the left and right depressions 41 can be formed by different conductors, and further the window 42 in the middle may also be formed by a different conductor. In regards to the numbers and the shapes of the depressions 41, 410 and/or windows 42, 420, various kinds and forms may be used.

In the above embodiments, although the depressions 41, 410 and the window 42, 420 have a rectangular shape, various shapes such as curve, round, oval or polygonal shapes can be used for this configuration. The depression 41, 410 and the window 42, 420 are formed in a vertically and laterally symmetrical shape, however symmetry is not always required.

In the above described embodiments, although a flattened rectangular shape waveguides 1, 10 were used as examples, it is not intended to be limited thereto. Those embodiments are also applicable to round or oval shape waveguides.

In the above described embodiments, attenuation pole waveguide bandpass filters 2 are configured in thin plate-like shapes, however the filters 2 are not necessary to be thin. If the filters have at least a configuration having depressions and windows, those can be relatively thick.

INDUSTRIAL APPLICATION

By developing downsized filters with a higher selectivity for an electromagnetic wave, a new business formation is expected as a collision avoidance system for vehicles and a home security system.

What is claimed is:

1. A waveguide having attenuation pole waveguide bandpass filters which are positioned at right angle to a radio wave propagation direction, wherein each of the attenuation pole waveguide bandpass filters is composed of a conductor and the conductor is provided with two or more depressions each opening outwardly, a window located between said depressions, and rounding sections which go around an end section from an inside of the depression.

2. The waveguide according to claim 1, wherein the attenuation pole waveguide bandpass filter is composed of the conductor, which is shaped as a plate, and the conductor is sandwiched at a joint between waveguide components.

3. The waveguide according to claim 1, wherein the rounding sections are covered by a dielectric composed of resin.

4. The waveguide according to any of claims 1 or 3, wherein two or more different kinds of the attenuation pole waveguide bandpass filters are attached along the radio wave propagation direction.

5. The waveguide according to any of claims 1 or 3, the depressions and the window are formed in a laterally symmetrical shape.

6. The waveguide according to any of claims 1 or 3, wherein the depressions and the window are formed in a vertically symmetrical shape.

7. The waveguide according to claim 1, further comprising a pair of cut-off guides configured to narrow a width in a vertical direction to the radio wave propagation direction, wherein the attenuation pole waveguide bandpass filters are arranged between said opposed cut-off guides.

8. An attenuation pole waveguide bandpass filter which is positioned at right angle to a radio wave propagation direction, wherein the attenuation pole waveguide bandpass filter is composed of a conductor and the conductor is provided with two or more depressions each opening outwardly, a window located between said depressions, and rounding sections which go around an end section from an inside of the depression.

9. The attenuation pole waveguide bandpass filter according to claim 8, wherein a surrounding section of the conductor is covered by a dielectric composed of resin.

* * * * *

UNITED STATES PATENT AND TRADEMARK OFFICE

CERTIFICATE OF CORRECTION

PATENT NO. : 7,538,640 B2
APPLICATION NO. : 11/665337
DATED : May 26, 2009
INVENTOR(S) : Tsuji et al.

It is certified that error appears in the above-identified patent and that said Letters Patent is hereby corrected as shown below:

On the Title Page, in Field (56), under "FOREIGN PATENT DOCUMENTS", in Column 2, Line 3, delete "JP 63-56802 4/1988".

In Column 10, Line 42, in Claim 5, delete "3, the" and insert -- 3, wherein the --, therefor.

Signed and Sealed this
Seventeenth Day of April, 2012

David J. Kappos

David J. Kappos
*Director of the United States Patent and Trademark Office*